US006374780B1

(12) United States Patent
Rutyna et al.

(10) Patent No.: US 6,374,780 B1
(45) Date of Patent: Apr. 23, 2002

(54) ELECTRIC WATERPUMP, FLUID CONTROL VALVE AND ELECTRIC COOLING FAN STRATEGY

(75) Inventors: Cindy Marie Rutyna, Plymouth; Peter Langer, Lexington, both of MI (US); Paul Raymond Murray, Park Ridge, IL (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/612,355

(22) Filed: Jul. 7, 2000

(51) Int. Cl.[7] ..... F01P 7/02
(52) U.S. Cl. ..... 123/41.12; 236/35
(58) Field of Search ..... 123/41.12, 41.1, 123/41.44; 236/35; 165/292

(56) References Cited

U.S. PATENT DOCUMENTS 4,475,485 A 10/1984 Sakakibara et al.
4,539,942 A 9/1985 Kobayashi et al.
4,587,223 A 5/1986 Gueyen
4,630,573 A 12/1986 Ogawa et al.
4,658,766 A 4/1987 Hirano
4,726,325 A 2/1988 Itakura
5,619,957 A 4/1997 Michels
5,724,924 A 3/1998 Michels
6,178,928 B1 * 1/2001 Corriveau ..... 123/41.12

* cited by examiner

*Primary Examiner*—Tony M. Argenbright
*Assistant Examiner*—Katrina Harris
(74) *Attorney, Agent, or Firm*—John E. Kajander

(57) ABSTRACT

A method and apparatus for controlling engine temperature in a closed circuit cooling system 12 of an automobile 10 having an electric water pump 34, a flow control valve 42, and electric fan 40. A powertrain control module 20 electrically coupled to the electric water pump 34, flow control valve 42 and electric fan 40 interprets inputs from various sensors to adjust the pumping speed of an electric water pump 34, adjust the rotational speed of an electric fan 40, and/or adjust the flow rate through a flow control valve 42 to the radiator 46 according to a look up table as a function of fuel economy, emissions, thermal management and electrical load management.

28 Claims, 3 Drawing Sheets

ELECTRIC WATERPUMP, FLUID CONTROL VALVE AND ELECTRIC COOLING FAN STRATEGY

TECHNICAL FIELD

The present invention relates generally to engine thermal management and more particularly to a method of optimizing engine thermal management as a function of electrical load management, fuel economy and emissions using an electric waterpump, a flow control valve, and an electric cooling fan.

BACKGROUND

Engine cooling systems typically have many functions on vehicles. Cooling systems may remove excess heat from the engine, maintain a constant engine operating temperature, increase the temperature in a cold engine quickly, and provide a means for warming a passenger compartment.

There are two types of automotive cooling systems: air and liquid. Air cooling systems use large cylinder cooling fins to remove excess heat from the engine. Liquid cooling systems circulate a solution of water and/or coolant through water jackets. The coolant collects excess heat and carries it out of the engine. Liquid cooling systems offer several advantages over air cooling systems, including more precise control of engine operating temperatures, less temperature variation inside the engine, reduced exhaust emissions because of better temperature control, and improved heater operation to warm passengers. As such, liquid cooling systems are typically used on automobiles today.

Liquid cooling systems generally consist of the engine water jacket, thermostat, water pump, radiator, radiator cap, fan, fan drive belt (if necessary) and necessary hoses.

The water pump is typically an impeller or centrifugal pump that forces coolant through the engine block, intake manifold, hoses, and radiator. It is driven by a fan belt running off the crankshaft pulley. The spinning crankshaft pulley causes the fan belt to turn the water pump pulley, pump shaft, and impeller. Coolant trapped between the impeller blades is forced outward, producing suction in the central area of the pump housing and pressure in the outer area of the housing. Since the pump inlet is near the center, pressurized coolant is pulled out of the radiator, through a lower hose, and into the engine. It circulates through the engine block, around the cylinders, up through the cylinder heads, and back into the radiator.

Cooling system fans pull air through the core of the radiator and over the engine to help remove heat. Typically, a belt or an electric motor drives the fan. Electric fan switches use an electric motor and a thermostatic switch to provide cooling action. When the engine is cold, the switch is open. This keeps the fan from spinning and speeds engine warm-up. After warm-up, the switch closes to operate the fan and provide cooling. An electric engine fan saves energy and increases cooling system efficiency by only functioning when needed. By speeding engine warm-up, it reduces emissions and fuel consumption.

One problem with commercial water pumps is that the flow rate of coolant is controlled by engine speed, not by the amount of cooling that the engine needs. Therefore, there is no way to optimize engine thermal management using a mechanical water pump alone. Thermal management during the engine warm-up stage is typically controlled by adding a thermostat between the water pump and radiator that restricts the flow of coolant to a radiator. In this way, the engine can warm up quickly in cold start conditions. However, engine thermal management after an engine is warmed up is strictly controlled by the engine speed, which causes the water pump to pump fluid cooled by the radiator through the engine. Thus, for example, when an automobile leaves a highway and enters city traffic, the engine speed and radiator cooling capability may not be adequate to cool the engine block in a timely manner. This could result in damage to vital engine components.

One way to optimize engine thermal management is to use an electric water pump. The pumping rate of the electric water pump could be modified as necessary to control fluid flow through an engine. For instance, in cold start up conditions, the electric water pump may be set at a slow pumping speed. As the temperature increases, the pumping speed may be correspondingly increased to a certain flow rate to control engine temperature. When used in conjunction with an electric fan and a flow control valve, the engine thermal management may be optimized.

SUMMARY OF THE INVENTION

It is thus an object of the present invention to provide an electric water pump, a flow control valve and an electric cooling fan optimization strategy that incorporates engine thermal management, electrical load management, engine emissions, and fuel economy.

The above and other objects are accomplished by providing a system that automatically adjusts the flow rate through the engine cooling system via a water pump and/or adjusts the cooling rate of an electric fan motor and/or adjusts the flow rate of coolant through the flow control valve to optimize engine thermal protection and corresponding emissions and fuel economy as a function of electric load management. A powertrain control module electronically coupled with the electric pump, flow control valve and electric fan determines when, and at what rate, the pump, a flow control valve and an electric fan are utilized based on various engine parameters. The powertrain control module controls various other system parameters in correlation with the electric pump, flow control valve and electric fan.

Other objects and advantages of the present invention will become apparent upon considering the following detailed description and appended claims, and upon reference to the accompanying drawings.

DESCRIPTION OF THE PREFERRED EMBODIMENT(S)

Figure 1:
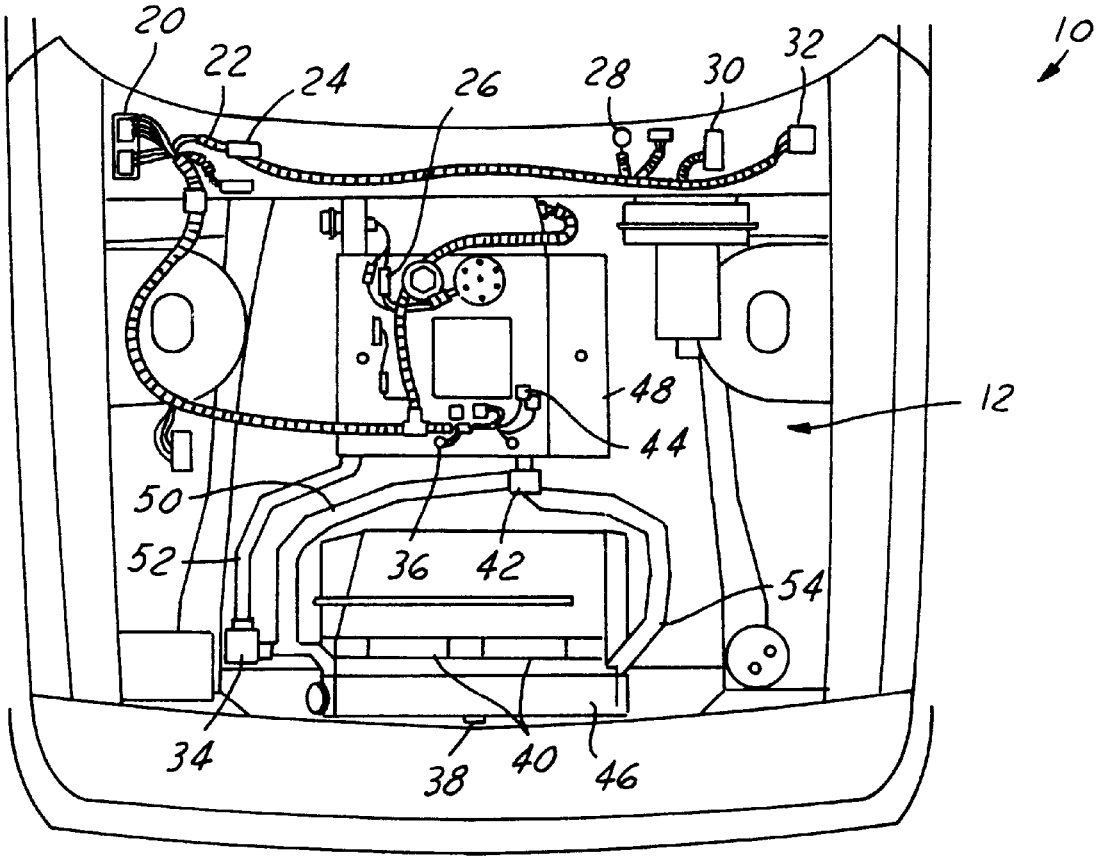
FIG. 1 is a perspective view of a vehicle having a cooling system according to a preferred embodiment of the present invention.

Referring now to FIG. 1, a vehicle 10 is illustrated having a cooling system 12 according to a preferred embodiment of the present invention. The cooling system 12 has a powertrain control module 20, a computer control harness 22, a check engine lamp driver 24, a cylinder head temperature sensor 26, a check engine light 28, a vehicle speed sensor 30, a fuse panel 32, an electric water pump 34, an engine coolant sensor 36, an ambient temperature sensor 38, a pair of electric cooling fans 40, a flow control valve 42, a throttle position sensor 44, and a radiator 46.

In operation, when an internal combustion engine 48 is started, coolant (not shown) enters the electric water pump 34 through a branch duct 50 from the radiator 46. Coolant is then pumped out of the water pump 34 through a return duct 52 and into the cooling passages (not shown) of the engine 48. The coolant flows through the engine to the flow control valve 42. Coolant will then flow back to the radiator 46 through the supply duct 54 or be bypassed through the branch duct 50 depending upon the engine coolant temperature as determined by the engine coolant temperature sensor 36. When the engine 48 is cool, the flow control valve 42 directs the coolant through the branch duct 50. If the engine 48 is warm, the flow control valve 42 directs the coolant through the supply duct 54 to the radiator 46, where the coolant is cooled. In this way, the engine 48 quickly heats up to optimal operating conditions and is maintained at those conditions thereafter.

To ensure that the engine 48 is maintained at a proper operating temperature, the powertrain control module 20 operates to maintain the coolant within a predetermined range of temperatures. This may be accomplished in many ways. First, the electric cooling fan 40 could be turned on or off, or the speed increased or decreased, to ensure that the coolant is within the range of acceptable temperatures. Second, the electric water pump 34 speed could be increased or decreased to either cool or warm the engine 48. Third, the flow rate through the flow control valve 42 and into the radiator 46 could be increased to cool the engine 48 or decreased to warm the engine 48. Finally, a combination of two or all of these controls may be used.

The present invention provides an optimal operating strategy for the cooling system 12 that incorporates thermal management, electrical load management, engine emissions, and fuel economy. A logic flow diagram for operating this cooling system 12 with an electric water pump 34, flow control valve 42 and electric fan 40 is discussed below.

Figure 2:
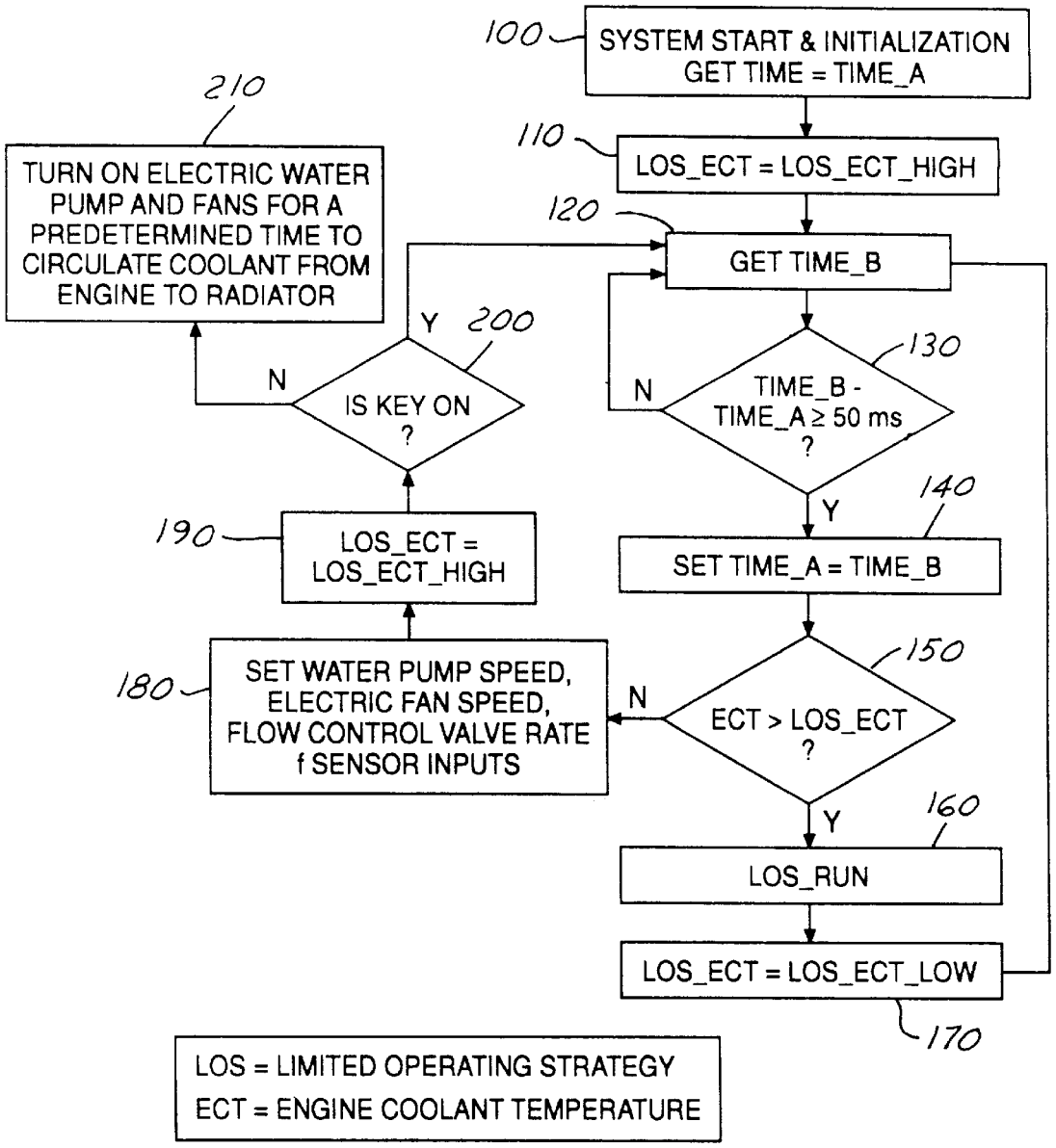
FIG. 2 is a logic flow diagram of a method for controlling the electric water pump, electric fan, and other engine components according to a preferred embodiment of the present invention.

Referring now to FIG. 2, a logic flow diagram for a preferred embodiment of the present invention is given. Beginning with Step 100, the system 12 is started and initialized. The time is initially determined and marked as Time_A. Next, in Step 110, the Limited Operating Strategy for Engine Coolant Temperature (LOS_ECT) is set to its maximum value (LOS_ECT_HIGH). LOS_ECT_HIGH is set for a system 12 based on the desired high-end engine coolant temperature for the particular application for which it is used. For a preferred embodiment of the present invention, when used on an automobile system, LOS_ECT_HIGH is set to 250 degrees Fahrenheit (121 degrees Celsius).

Next, in Step 120, the current time (Time_B) is determined. In Step 130, Time_B is compared to Time_A. If there is not a difference of at least 50 milliseconds between Time_A and Time_B, the logic proceeds back to Step 120, otherwise the logic proceeds to Step 140, where Time_A is set equal to Time_B.

The logic then proceeds to Step 150, where a determination is made as to whether the engine coolant temperature (ECT), as determined by the engine coolant temperature sensor 36, is greater than LOS_ECT_HIGH. If it is, proceed to Step 160, otherwise proceed to Step 180.

Figure 3:
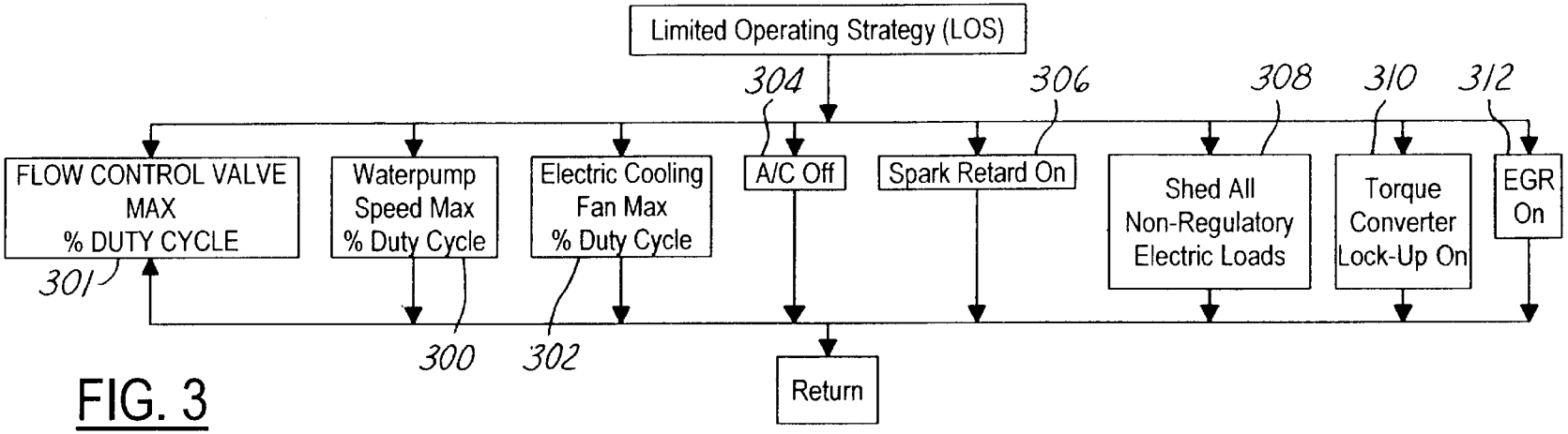
FIG. 3 is a more detailed logic flow diagram of Step 160 of FIG. 2.

In Step 160, the Limited Operating Strategy (LOS) is executed. FIG. 3 is a more detailed diagram of Step 160. In FIG. 3, the powertrain control module 20 directs that the electric water pump 34 is set to its maximum speed (or maximum % duty cycle) in Step 300, the flow control valve 42 is set to its maximum value (corresponding to fully open, thereby directing all of the coolant to enter the radiator 46) in Step 301, and the electric cooling fan 40 is set to its maximum speed (or maximum % duty cycle) in Step 302. In addition, the air conditioning unit (not shown) is turned off (Step 304), the spark retard is turned on (Step 306), all non-regulatory loads are shed (Step 308), the torque converter lockup is turned on (Step 310), and the exhaust gas recirculation (EGR) valve is turned on (Step 312) in an effort to cool the engine 48 and cylinder heads (not shown) as quickly as possible to an acceptable temperature. Examples of non-regulatory loads may include a heated rear window, heated seats, rear seat entertainment devices, or any other optional electrical equipment typically found on vehicles. By turning off the air conditioner, retarding ignition spark, and shedding some or all non-regulatory electrical loads, the electrical load on the system 12 is decreased, which leads to cooler engine temperatures.

Returning to FIG. 2, hysteresis is taken into account in Step 170 by having the powertrain control module 20 set the LOS_ECT to its minimum value (LOS_ECT_LOW). The LOS_ECT_LOW is preferably approximately 10 degrees Fahrenheit lower than the LOS_ECT_HIGH, or approximately 240 degrees Fahrenheit (116 degrees Celsius). The logic then proceeds back to Step 120.

In Step 180, the actual engine coolant temperature as determined by engine coolant temperature sensor 36 is signaled to the powertrain control module 20 to set the water pump 34 speed, the flow control valve 42 opening, and the electric fan 40 speed. The values are predetermined and available to the logic in the form of a look-up table. Next in Step 190, the LOS_ECT is set to its maximum value (LOS_ECT_HIGH) by the powertrain control module 20.

Next, in Step 200, the powertrain control module 20 determines whether the key is on or off. If the key is on, proceed back to Step 120. If the key is off, Step 210 is implemented, in which the powertrain control module 20 turns on the electric water pump 34 and the electric fans 40 for a predetermined amount of time sufficient to circulate the coolant from the engine 48 to the radiator 46 to prevent the coolant from boiling over within the engine 48.

Figure 4:
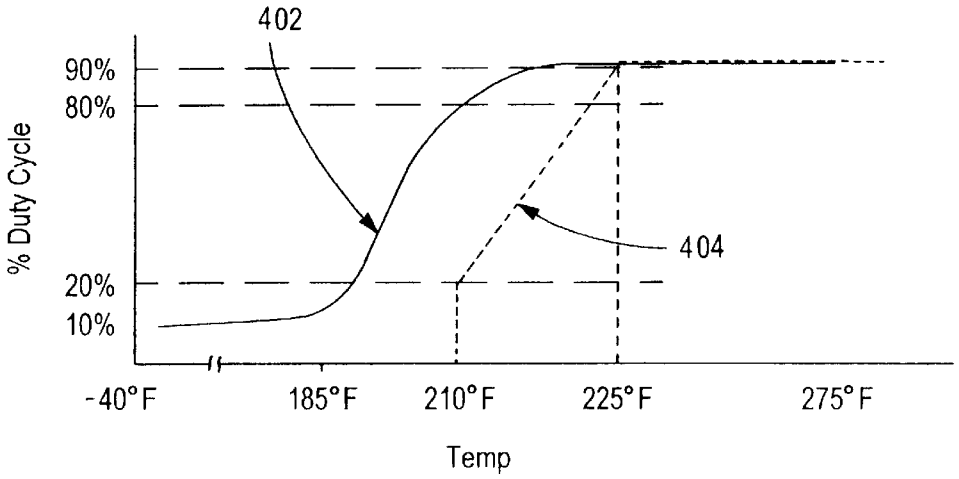
FIG. 4 is a lookup table of Step 180 of FIG. 2.

Referring now to FIG. 4, the look-up table of Step 180 is illustrated in graph form. The calibratable look-up table determines the proper duty cycle for the electric water pump 34 (as indicated by line 402) and for the electric fan 40 (as indicated by line 404) as a function of the engine coolant temperature. The duty cycles in the preferred embodiment for the electric water pump 34 range from 10% to 90%, with 10% corresponding to a pumping speed of approximately 1000 rpm and 90% corresponding to a pumping speed of approximately 5500 rpm for a 42V water pump. Further, the electric fan 40 ranges from 0% to 100%, with 0% corresponding to the fan 40 is turned off and 90% corresponding to the maximum fan speed possible when the fans 40 are in operation. As the duty cycle approaches its respective maximum values, the amount of electrical load used by the particular part (pump 34 or fan 40) correspondingly rises. While not graphically depicted, the look-up table of FIG. 4 also directs the flow control valve 42 to an open position (wherein coolant flows through the supply duct 54 and into the radiator 46), shut position (wherein coolant does not flow through the radiator 46, instead flowing through the branch duct 50 to the electric water pump 34), or a position therebetween (wherein coolant flows through both the branch duct 50 and the supply duct 54).

For example, at lower engine coolant temperatures (between −40 degrees Fahrenheit and 185 degrees Fahrenheit (−40 to 85 degrees Celsius), the powertrain control module 20 directs that the electric pump 34 be pumping at approximately 10% duty cycle based on the actual engine coolant temperature according to the look up table, while further directing that the electric fan 40 is turned off. Between 185 degrees and 210 degrees Fahrenheit (85 and 100 degrees Celsius), the duty cycle of the electric water pump 34 is increased from 10% to 80% in a substantially linear fashion according to a predetermined ramp rate. At 210 degrees Fahrenheit (100 degrees Celsius), the powertrain control module 20 directs that the electric fan 40 is switched on and the speed of the rotation raised to 20% duty cycle. As the temperature increases further, the duty cycle of the fan 40 and the pump 34 are increased according to the look-up table until they reach their maximum values of 90%. In addition, the powertrain control module 20 directs the flow control valve 42 according to the look up table to an open, closed or partially open position at various coolant temperatures, pump 34 speeds and fan 40 speeds. In this way, the engine 48 is cooled as rapidly as possible to optimize fuel economy, emissions, and electrical load usage.

As the engine speed is increased above a predetermined speed as measured by the vehicle speed sensor 30 and the engine coolant temperature falls below a predetermined value, the powertrain control module 20 shuts off the electric fan 40. In the preferred embodiment of the present invention, this occurs at a vehicle speed of 48-mph or greater and an engine coolant temperature below 212 degrees Fahrenheit (100 degrees Celsius). The air flowing through the vehicle 10 at these speeds is then used to cool the coolant flowing through the radiator 46. This further increases fuel economy by decreasing the electrical load within the system 12. Further, the powertrain control module 20 directs the electric fan 40 to be turned off at less than the predetermined speed, where the ambient temperature, as measured by an ambient temperature sensor 38 and the engine coolant temperature, as measured by the engine coolant temperature sensor 36, are below a predetermined temperature.

While the logic shown above indicates a preferred embodiment of the present invention, it is specifically contemplated that variations may be made. For example, in the Limited Operating Strategy of Step 160, depending upon the operating parameters set up in Act the system, only some non-regulatory electric loads may need to be shed to achieve the same preferred result.

Further, it is specifically contemplated that the logic flow diagram of FIG. 2 could use cylinder head temperature (as opposed to engine coolant temperature) as measured by a cylinder head temperature sensor 26 to control the electric water pump 34 and electric fan 40 as a function of fuel economy, emissions, and electric load management. In addition, a system 12 is contemplated that uses both cylinder head temperature and engine coolant temperature to control the electric water pump 34, flow control valve 42 and electric fan 40 as a function of fuel economy, emissions, thermal management, and electric load management.

Further, it is specifically contemplated that there are certain operating conditions where the strategy of the present invention may be modified. For example, where a vehicle operator is driving on a highway for a long period of time, the powertrain control module 20 may direct the electric water pump 34, flow control valve 42, or electric fan to run at slightly elevated engine 48 temperatures to improve some other engine parameter, such as fuel economy.

Thus, the present invention provides an apparatus and method for controlling engine coolant temperature in a closed loop cooling system 12 that controls engine 48 coolant temperature or cylinder head temperature while optimizing electrical load management, thermal management, fuel economy, and emissions at all temperatures.

While the invention has been described in terms of preferred embodiments, it will be understood, of course, that the invention is not limited thereto since modifications may be made by those skilled in the art, particularly in light of the foregoing teachings.

What is claimed is:

1. A cooling system control apparatus for controlling the temperature of engine coolant in a coolant-cooled engine comprising:

a radiator for cooling the engine coolant;

at least one electric fan for supplying air to said radiator;

an electric water pump for circulating said engine coolant through an engine cooling system circuit including said radiator;

a flow control valve coupled between said engine and said electric water pump;

a plurality of input sensors; and a powertrain control unit electrically coupled to said at least one electric fan, said flow control valve, said electric water pump and said plurality of input sensors, said powertrain control unit adapted to control the operation of said electric water pump, said flow control valve and said electric fan as a function of said input sensors to optimize fuel economy, emissions, thermal management and electrical load management.

2. The apparatus of claim 1 further comprising an air conditioning unit electrically coupled to said powertrain control unit, wherein said powertrain control unit controls the operation of said air conditioning unit as a function of said input sensors to optimize fuel economy, emissions, thermal management and electrical load management.

3. The apparatus of claim 1 further comprising a plurality of non-regulatory electrical load devices electrically coupled to said powertrain control unit, wherein said powertrain control unit controls the operation of said plurality of non-regulatory electrical load devices as a function of said input sensors to optimize fuel economy, emissions, thermal management and electrical load management.

4. The apparatus of claim 1 further comprising an air conditioning unit and a plurality of non-regulatory electrical load devices electrically coupled to said powertrain control unit, wherein said powertrain control unit controls the operation of said air conditioning unit and said plurality of non-regulatory electrical load devices as a function of said input sensors to optimize fuel economy, emissions, thermal management and electrical load management.

5. The apparatus of claim 1, wherein said input sensors are selected from a group consisting of an engine coolant sensor, a cylinder head temperature sensor, a vehicle speed sensor, an ambient temperature sensor, and a throttle position sensor.

6. A method of controlling engine temperature in a closed circuit cooling system having an electric water pump, a flow control valve and an electric fan, the method comprising the steps of:

adjusting the pumping speed of the electric water pump as a function of fuel economy, emissions, thermal management and electrical load management;

adjusting the rotational speed of the electric fan as a function of fuel economy, emissions thermal management and electrical load management; and adjusting the flow rate through a flow control valve as a function of fuel economy, emission, thermal management, and electrical load management.

7. The method of claim 6 further comprising the steps of:

adjusting an air conditioning unit as a function of fuel economy, emissions, thermal management and electrical load management;

adjusting an amount of spark retard as a function of fuel economy, emissions, thermal management and electrical load management;

adjusting a torque converter lock-up as a function of fuel economy, emissions, thermal management, and electrical load management;

adjusting an exhaust gas recirculation valve as a function of fuel economy, emissions, thermal management, and electrical load management; and shedding at least one of a plurality of non-regulatory electric loads as a function fuel economy, emissions, thermal management and electrical load management.

8. The method of claim 6, further comprising the step of adjusting said pumping speed of the electric water pump as a function of engine coolant temperature, engine speed signal, vehicle speed, and ambient temperature.

9. The method of claim 6, further comprising the step of adjusting said rotational speed of the electric fan as a function of engine coolant temperature, engine speed signal, engine load signal, vehicle speed, and ambient temperature.

10. The method of claim 6, further comprising the step of adjusting the flow rate through a flow control valve as a function of engine coolant temperature, engine speed signal, engine load signal, vehicle speed, and ambient temperature.

11. The method of claim 6, further comprising the steps of adjusting said pumping speed of the electric water pump as a function of engine coolant temperature, engine speed signal, vehicle speed, and ambient temperature and adjusting said rotational speed of the electric fan as a function of engine speed signal, engine load signal, vehicle speed, and ambient temperature.

12. The method of claim 6, further comprising the step of adjusting said pumping speed of the electric water pump as a function of cylinder head temperature, engine speed signal, engine load signal, vehicle speed, and ambient temperature.

13. The method of claim 6, further comprising the step of adjusting said rotational speed of the electric fan as a function of cylinder head temperature, engine speed signal, engine load signal, vehicle speed, and ambient temperature.

14. The method of claim 6, further comprising the step of adjusting said flow rate through said flow control valve as a function of cylinder head temperature, engine speed signal, engine load signal, vehicle speed, and ambient temperature.

15. The method of claim 6, further comprising the step of adjusting said pumping speed of the electric water pump and adjusting said rotational speed of the electric fan and adjusting said flow rate through said flow control valve as a function of engine coolant temperature, engine speed signal, engine load signal, vehicle speed, and ambient temperature.

16. A method of controlling engine temperature in a closed circuit cooling system of an automobile while optimizing fuel economy, emissions, thermal management and electrical load management, the method comprising the steps of:

adjusting the pumping speed of an electric water pump when a first set of operating conditions is present;

adjusting the rotational speed of an electric fan when a second set of operating conditions is present; and adjusting the flow rate of coolant through a flow control valve when a third set of operating conditions is present, wherein said third set of operating conditions is a function of said first set of operating conditions and said second set of operating conditions.

17. The method of claim 16 further comprising the steps of:

turning off an air conditioning unit when a fourth set of operating conditions is present;

adjusting the spark retard in the engine when said fourth set of operating conditions is present;

adjusting a torque converter lock-up when said fourth set of operating conditions is present;

adjusting an exhaust gas recirculation valve when said fourth set of operating conditions is present; and shedding at least one of a plurality of non-regulatory electrical loads when said fourth set of operating conditions is present.

18. The method according to claim 16, wherein the step of adjusting the pumping speed of an electric water pump when a first set of operating conditions is present comprises the step of increasing the water pump speed to its predetermined maximum level when the engine coolant temperature exceeds a predefined maximum value.

19. The method according to claim 16, wherein the step of adjusting the rotational speed of an electric fan when a second set of operating conditions is present comprises the step of increasing the electric fan speed to its predetermined maximum level when the engine coolant temperature exceeds a predefined maximum value.

20. The method according to claim 17, wherein the steps of turning off an air conditioning unit, adjusting the spark retard, and shedding at least one of a plurality of non-regulatory electrical loads when a fourth set of operating conditions is present comprises the step of turning off an air conditioning unit, adjusting the spark retard, and shedding at least one of a plurality of non-regulatory electrical loads when the engine coolant temperature exceeds said predetermined maximum value.

21. The method according to claim 20, wherein the steps of turning off an air conditioning unit, adjusting the spark retard, and shedding at least one of a plurality of non-regulatory electrical loads when the engine coolant temperature exceeds said predetermined maximum value comprises the step of turning off an air conditioning unit, adjusting the spark retard, and shedding at least one of a plurality of non-regulatory electrical loads when the engine coolant temperature exceeds approximately 250 degrees Fahrenheit.

22. The method according to claim 16, wherein the step of adjusting the pumping speed of an electric water pump when a first set of operating conditions is present comprises the step of operating the pumping speed of an electric water pump at a predetermined minimum pumping speed when the engine coolant temperature is less than approximately 185 degrees Fahrenheit.

23. The method according to claim 16, wherein the step of adjusting the pumping speed of an electric water pump when a first set of operating conditions is present comprises the step of operating an electric water pump at a predetermined maximum pumping speed when the engine coolant temperature is greater than approximately 220 degrees Fahrenheit.

24. The method according to claim 16, wherein the step of adjusting the pumping speed of an electric water pump when a first set of operating conditions is present comprises the step of operating an electric water pump between a predetermined minimum pumping speed and a predetermined maximum pumping speed when the engine coolant temperature is greater than or equal to approximately 185 degrees Fahrenheit and less than or equal to approximately 220 degrees Fahrenheit.

25. The method according to claim 16, wherein the step of adjusting the rotational speed of an electric fan when a second set of operating conditions is present comprises the step of turning off said electric fan when the engine coolant temperature is less than approximately 210 degrees Fahrenheit.

26. The method according to claim 16, wherein the step of adjusting the rotational speed of an electric fan when a second set of operating conditions is present comprises the step of operating an electric fan between a predetermined minimum rotational speed and a predetermined maximum rotational speed when the engine coolant temperature is greater than or equal to approximately 210 degrees Fahrenheit and less than or equal to approximately 225 degrees Fahrenheit.

27. The method according to claim 16, wherein the step of adjusting the rotational speed of an electric fan when a second set of operating conditions is present comprises the step of operating an electric fan at a predetermined maximum rotational speed when the engine coolant temperature is greater than approximately 225 degrees Fahrenheit.

28. The method according to claim 16, wherein the step of adjusting the rotational speed of an electric fan when a second set of operating conditions is present comprises the step of operating an electric fan at a predetermined minimum rotational speed when the engine coolant temperature is less than a predetermined temperature and the vehicle speed is greater than a predetermined speed.

* * * * *